US006655169B2

(12) United States Patent
Tupis et al.

(10) Patent No.: US 6,655,169 B2
(45) Date of Patent: Dec. 2, 2003

(54) REFRIGERATOR AIRFLOW DISTRIBUTION ASSEMBLY

(75) Inventors: Jeffery Allen Tupis, Louisville, KY (US); Martin Christopher Severance, Louisville, KY (US); Arthur Wilson Scrivener, Louisville, KY (US); Gerald Eugene Sturgeon, Louisville, KY (US); Richard DeVos, Goshen, KY (US); Steven Gray, Prospect, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/754,539

(22) Filed: Jan. 5, 2001

(65) Prior Publication Data

US 2003/0037564 A1 Feb. 27, 2003

(51) Int. Cl.[7] ..... F25D 17/04
(52) U.S. Cl. ..... 62/417; 62/440; 62/455; 62/418; 62/408
(58) Field of Search ..... 62/455, 440, 418, 62/408, 417

(56) References Cited

U.S. PATENT DOCUMENTS 5,460,010 A * 10/1995 Kobayashi et al. ..... 62/187
5,555,736 A * 9/1996 Wills et al. ..... 62/187
5,706,673 A * 1/1998 Shin ..... 62/455
5,722,252 A * 3/1998 Kang et al. ..... 62/455
5,996,361 A * 12/1999 Bessler et al. ..... 62/163
6,250,092 B1 * 6/2001 Lanz et al. ..... 62/187
6,318,099 B1 * 11/2001 Hwang ..... 62/187
6,343,477 B1 * 2/2002 Mandel et al. ..... 62/187

* cited by examiner

*Primary Examiner*—Timothy L. Maust
*Assistant Examiner*—Mark S Shulman
(74) *Attorney, Agent, or Firm*—H. Neil Houser, Esq.; Armstrong Teasdale, LLP

(57) ABSTRACT

A refrigerator airflow distribution assembly includes an airflow diverter in flow communication with freezer compartment air. The diverter includes a primary flow path and at least one diverter opening therethrough, and together with a cover forms a secondary flow path in flow communication with the first flow path through the diverter opening. Freezer compartment air is directed to the primary flow path, and a portion of the air in the primary flow path flows through the diverter openings and into the secondary flow path, and is introduced to the fresh food compartment through one or more vents in the cover. Metered airflow through the diverter reduces temperature gradients in the refrigerator, as well as provides a regulated temperature source for a storage drawer in the fresh food storage compartment.

20 Claims, 6 Drawing Sheets

REFRIGERATOR AIRFLOW DISTRIBUTION ASSEMBLY

BACKGROUND OF THE INVENTION

This invention relates generally to refrigerators, and more specifically, to an apparatus for reducing temperature gradients in refrigerator fresh food compartments.

Known refrigerators typically regulate a temperature of a fresh food compartment by opening and closing a damper established in flow communication with a freezer compartment, and by operating a fan to draw cold freezer compartment air into the fresh food compartment as needed to maintain a desired temperature in the fresh food compartment.

In known refrigerators, however, achieving uniform temperatures in the fresh food compartment is challenging. For a variety of reasons, items placed in upper regions of the fresh food compartment tend to be undercooled, and items placed in lower regions of the fresh food compartment tend to be overcooled. While efforts have been made to control and improve airflow distribution in refrigerator fresh food compartments, see, for example U.S. Pat. No. 6,055,820, lower cost and simpler airflow distribution systems are desired.

BRIEF SUMMARY OF THE INVENTION

In an exemplary embodiment, an airflow distribution assembly for a refrigerator includes an airflow diverter coupled to a cover and in flow communication with freezer compartment air. The diverter includes a primary flow path and at least one diverter opening therethrough, and the cover and diverter form a secondary flow path in flow communication with the first flow path through the diverter opening. Freezer compartment air is directed to the primary flow path, and a portion of the air in the primary flow path flows through the diverter opening and into the secondary flow path. From the secondary flow path, the cold air is introduced to the fresh food compartment through one or more vents in the cover.

More specifically, the diverter includes a plurality of openings between the primary flow path and the secondary flow path of different sizes to obtain desired flow rates into the secondary flow path to achieve balanced airflow into the fresh food compartment through the cover vents, thereby reducing temperature gradients in the fresh food compartment. The secondary flow path includes a longitudinal portion extending substantially vertically in the fresh food compartment, and a plurality of laterally extending portions located adjacent the vents. The cover vents are located adjacent the lateral portions of the secondary flow path, and the cover is rounded to uniformly direct cold air from the secondary flow path into the fresh food compartment. A sealing gasket extends between the diverter and the cover to prevent mixing of cold freezer compartment air with warmer fresh food compartment air except through the cover vents.

A lower end of the airflow distribution assembly includes a discharge extending from the cover to supply cold freezer compartment air to a fresh food compartment storage drawer to regulate temperature in the storage drawer, for example, for meat and/or vegetable storage therein.

A versatile airflow distribution assembly is therefore provided that improves airflow in a refrigerator fresh food compartment and reduces undesirable temperature gradients in the fresh food compartment, as well as supplying cold air to a storage drawer for regulating temperature therein.

DETAILED DESCRIPTION OF THE INVENTION

Figure 1:
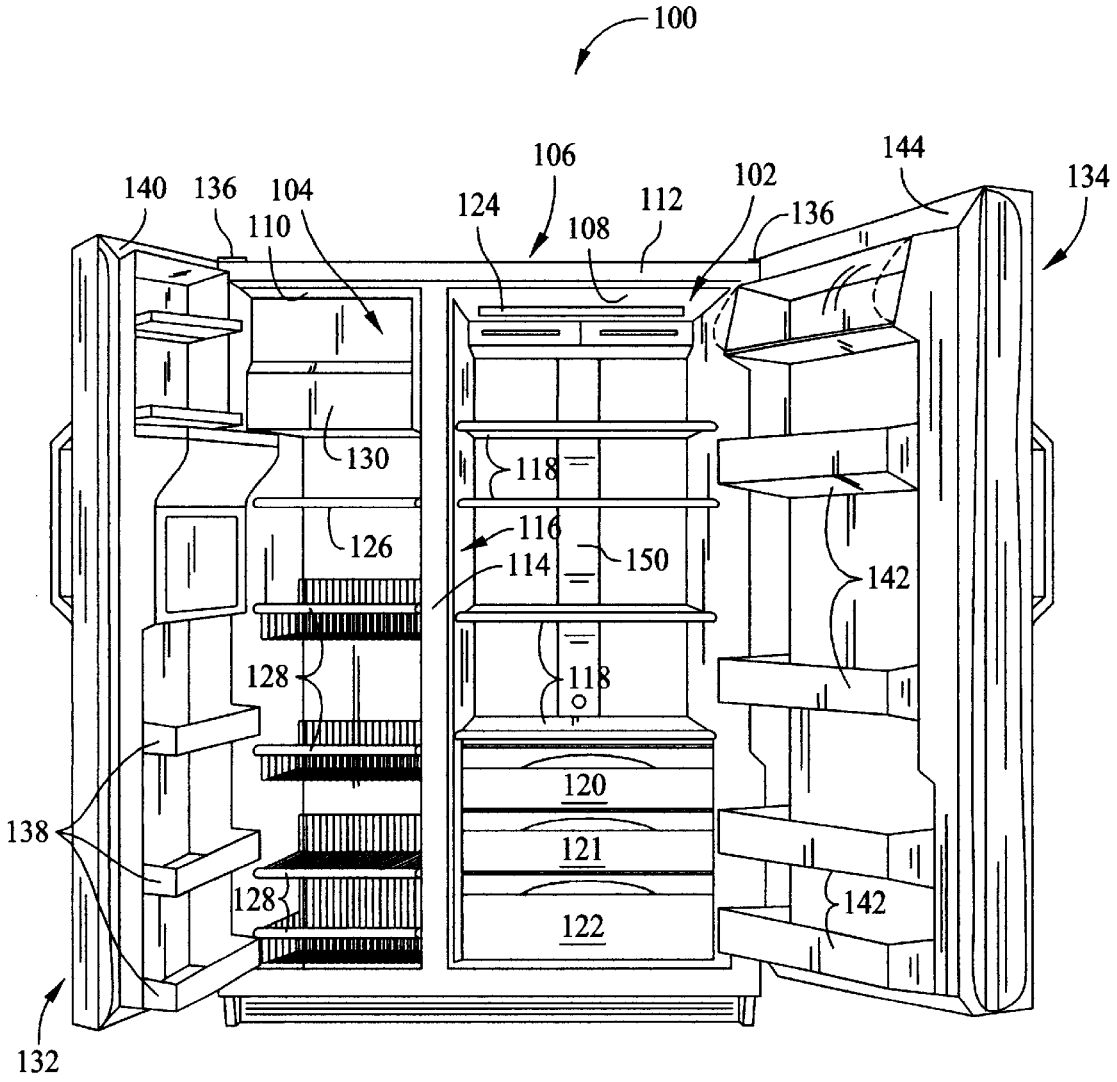
FIG. 1 is a perspective view of a refrigerator including an airflow distribution assembly.

FIG. 1 illustrates an exemplary side-by-side refrigerator 100 in which the invention may be practiced. It is contemplated, however, that the teaching of the description set forth below is applicable to other types of refrigeration appliances, including but not limited to top and bottom mount refrigerators wherein undesirable temperature gradients exist. The present invention is therefore not intended to be limited to be limited to any particular type or configuration of a refrigerator, such as refrigerator 100.

Refrigerator 100 includes a fresh food storage compartment 102 and freezer storage compartment 104, an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 106, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120, 121 normally are provided in fresh food compartment 102 to support items being stored therein. A bottom drawer or pan 122 partly forms a quick chill and thaw system (not shown in FIG. 1) selectively controlled, together with other refrigerator features, by a microprocessor (not shown) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

For improved airflow and reduced temperature gradients within fresh food compartment 102, an airflow distribution assembly 150 extends along a rear wall of fresh food compartment 102. As explained below, airflow distribution assembly provides metered distribution of cold air from freezer compartment 104. In addition, airflow distribution supplies cold air to slide-out drawer 120 for temperature regulation of meat and/or vegetables stored therein.

Figure 2:
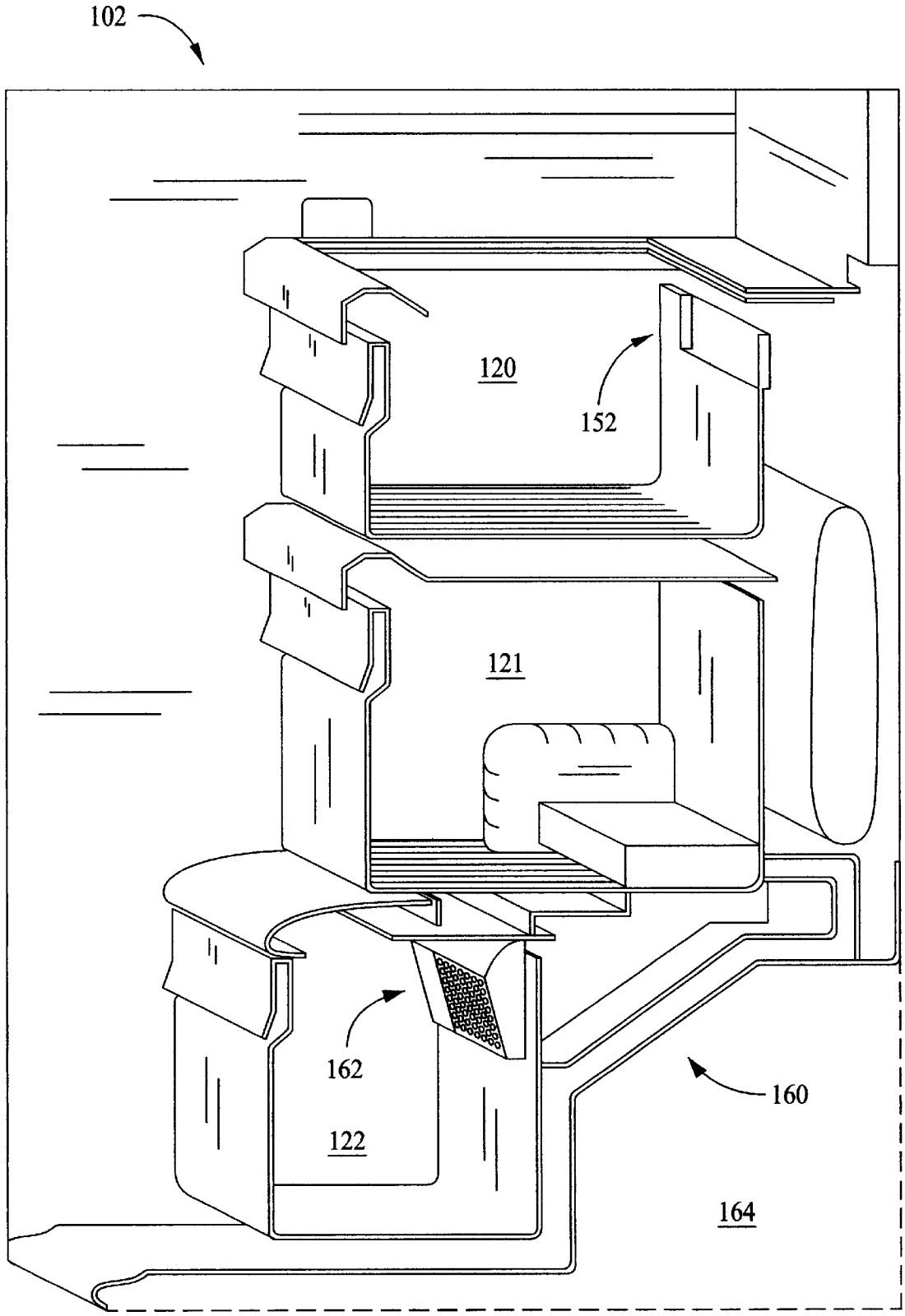
FIG. 2 is a partial perspective cut away view of a portion of the refrigerator shown in Figure.

FIG. 2 is a partial cutaway view of fresh food compartment 102 illustrating storage drawers 120, 121 stacked upon one another and positioned above a quick chill and thaw system 160. Quick chill and thaw system 160 includes an air handler 162 and pan 122 located adjacent a pentagonal-shaped machinery compartment 164 (shown in phantom in FIG. 2) to minimize fresh food compartment space utilized by quick chill and thaw system 160. Storage drawers 120 includes a rear wall 152 having a cutout portion therein for receiving regulated airflow from airflow distribution assembly 150 (shown in FIG. 1). Slide-out drawer 121 is a conventional slide-out drawer without internal temperature control, and a temperature of storage drawer 121 is therefore substantially equal to an operating temperature of fresh food compartment 102. In an alternative embodiment, drawer 121 also receives cold air from airflow distribution assembly 150.

Quick chill and thaw pan 122 is positioned slightly forward of storage drawers 120 to accommodate machinery compartment 164, and an air handler 162 selectively controls a temperature of air in pan 122 and circulates air within pan 122 to increase heat transfer to and from pan contents for timely thawing and rapid chilling, respectively. When quick thaw and chill system 160 is inactivated, pan 122 reaches a steady state at a temperature equal to the temperature of fresh food compartment 102, and pan 122 functions as a third storage drawer. In alternative embodiments, greater or fewer numbers of storage drawers 120, 121 and quick chill and thaw systems 160, and other relative sizes of quick chill pans 122 and storage drawers 120, 121 are employed. Further, it is recognized that the benefits of the present invention are achieved independently of quick chill and thaw system 160 and quick chill and thaw pan 122, and the invention is therefore not limited in any manner whatsoever to refrigerators including a quick chill and thaw system 160.

In accordance with known refrigerators, machinery compartment 164 at least partially contains components for executing a vapor compression cycle for cooling, air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing, through the evaporator, thereby causing, the refrigerant to vaporize.

The vapor cycle components are controlled by a microprocessor and deliver cooled air to freezer compartment 104 (shown in FIG. 1). Temperature regulation of fresh food compartment 102 (shown in FIG. 1) is obtained by opening, or closing, a damper in flow communication with an opening through center mullion wall 116 (shown in FIG. 1) and drawing air into fresh food compartment 102 with a fan (not shown). Airflow distribution assembly 150 (shown in FIG. 1) provides even distribution of freezer compartment air throughout fresh food compartment 102 and into slide out drawer 120 for meat and vegetable temperature regulation.

Figure 3:
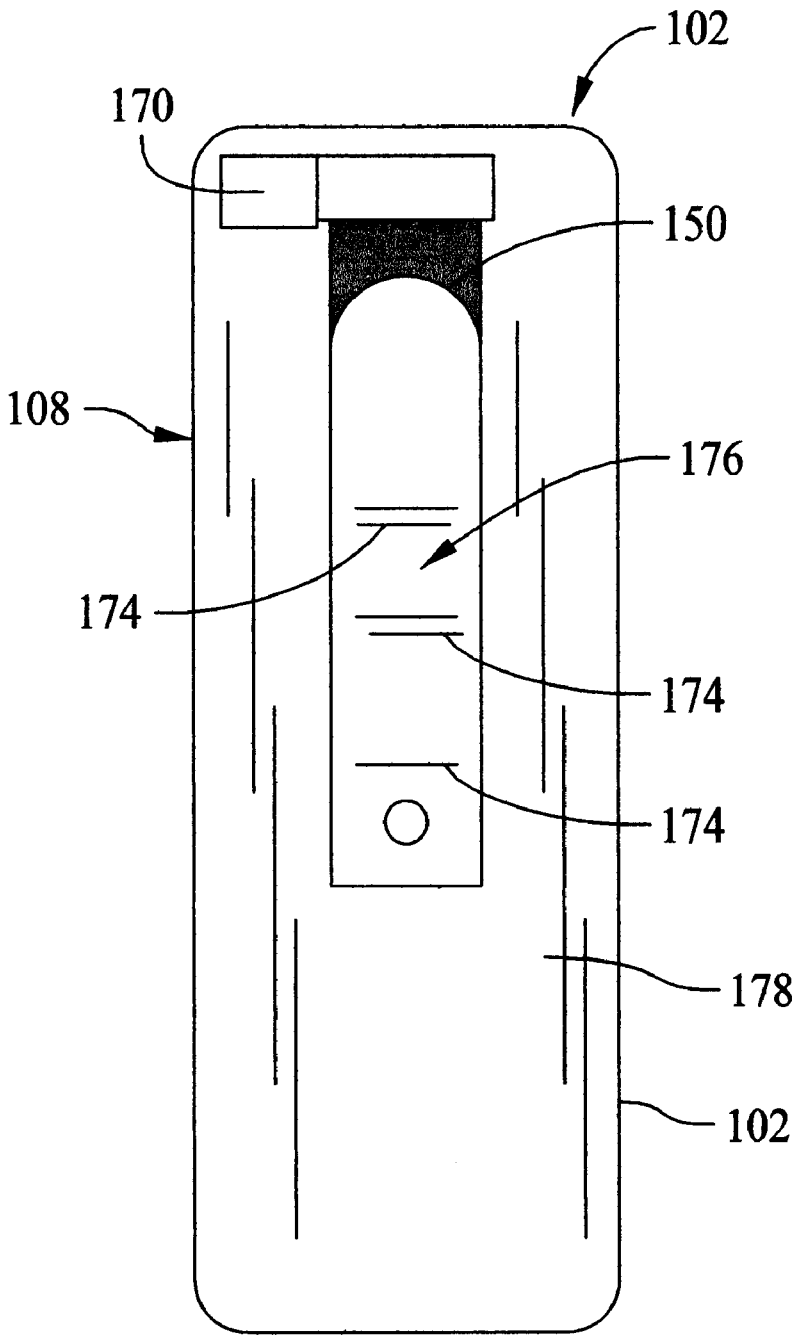
FIG. 3 is a front elevational view of a portion of the refrigerator shown in FIG. 1.

FIG. 3 is a front elevational view of fresh food compartment 102 and including air distribution assembly 150 attached to a rear wall of liner 108. Air distribution assembly 150 is in flow communication with freezer compartment 104 (shown in FIG. 1) through a duct 170 and a damper (not shown) in flow communication with an opening through center mullion wall 116 (shown in FIG. 1). Duct 170 is located at the top of fresh food compartment 102, and a fan (not shown) is used to draw freezer compartment air though the damper and duct 170 and downwardly into fresh food compartment 102 through vents 174 in a cover 176 of air distribution assembly 150. Cover 176 extends substantially from a top of fresh food compartment 102 to a mid-section of fresh food compartment 102 and is substantially centered between side walls of fresh food liner 108. A lower end of air distribution assembly includes a discharge 178 having vents for supplying freezer compartment air to storage drawer 120 (shown in FIGS. 1 and 2) and regulate temperature therein.

In alternative embodiments, other relative positions of duct 170 and air distribution assembly 150 are employed with respect to one another and with respect to fresh food compartment 102. For example, in one alternative embodiment, air distribution assembly 150 is attached to a side wall of fresh food liner 108. In a further alternative embodiment, duct 170 is located elsewhere than at the top of fresh food compartment 102 and air distribution assembly is used to direct air upwardly and/or downwardly from duct 170 to fresh food compartment 102. In still another alternative embodiment, air distribution assembly 150 is off-centered on one of the vertical walls of liner 108

Figure 4:
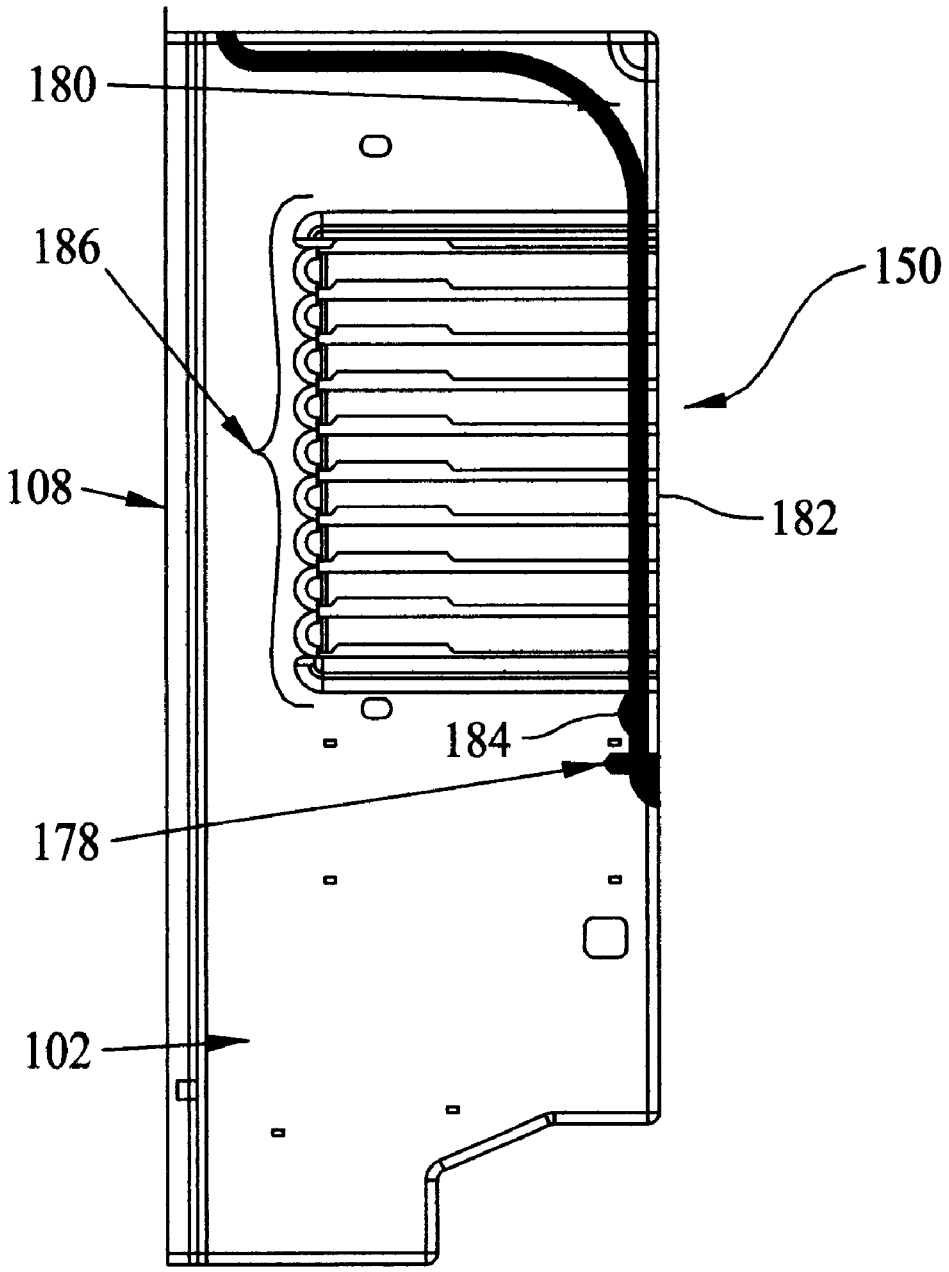
FIG. 4 is a sectional view of the portion of the refrigerator shown in FIG. 4.

FIG. 4 is a sectional view of fresh food compartment 102 illustrating air distribution assembly extending along a top and rear wall of liner 108. Air a n distribution assembly includes a hood portion 180 extending along the top of fresh food compartment 102, discharge 178 positioned for engagement with cutout portion of storage drawer 120 (see FIG. 2), and a vent portion 182 extending between hood portion 180 and discharge 178. In one embodiment, a manually adjustable knob 184 is located proximally to discharge 178 for user adjustment of airflow through discharge 178 into storage drawer 120. In an alternative embodiment, electronic controls are employed to select, deselect, and adjust airflow into storage drawer 120.

Air distribution assembly 150, as illustrated in FIG. 4, is compact in size to minimize impact on useable space in fresh food compartment 102, while providing regulated airflow into lower portions of fresh food compartment 102 to reduce temperature gradients therein. Vents 174 (shown in FIG. 3) are strategically positioned at selected vertical elevations to optimize airflow conditions in fresh food compartment 102 over a range of shelf positions 186 with respect to liner 108.

In a further embodiment, air distribution assembly 150 also directs regulated air downwardly below discharge 178 so that air is directed behind storage drawers 120 and 121 (shown in FIG. 2) and ultimately between storage drawers 120 and 122 toward a front of fresh food compartment 102. As such, cold air is directed into and around lower bins 142 of fresh food compartment door 134.

Figure 5:
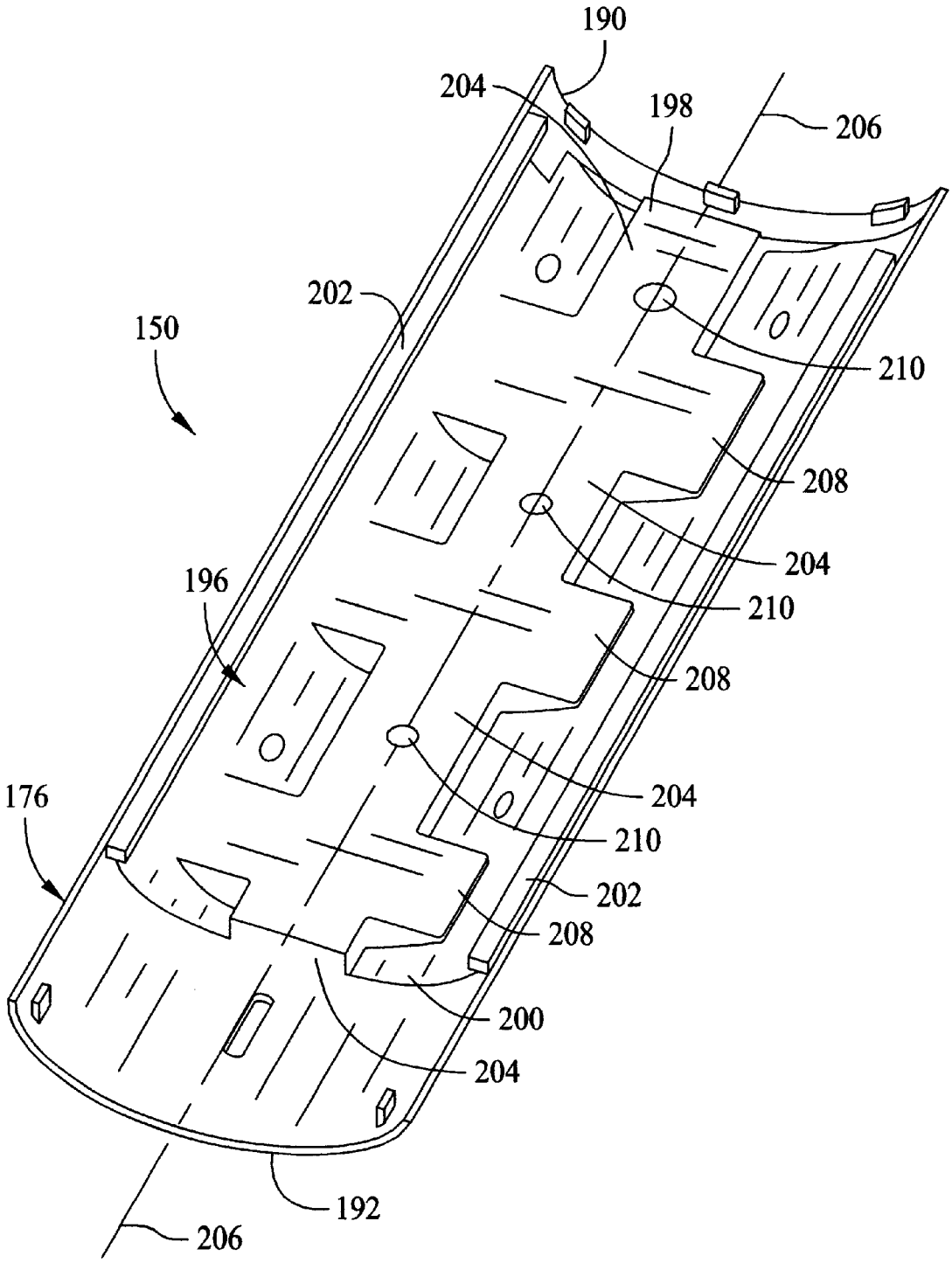
FIG. 5 is a perspective view of the airflow distribution assembly shown in FIGS. 1–4.

FIG. 5 is a perspective view of vent portion 182 of airflow distribution assembly 150 (shown in FIGS. 1, 3 and 4). Vent portion 182 includes cover 176 including an inlet end 190 and an outlet end 192, and a diverter 196 including an inlet end 198 and an outlet end 200 corresponding to ends 190, 192 of cover 176. Diverter 196 is coupled to cover 176, and a gasket 202 extends between diverter 196 and cover 196 to form an airtight seal between cover 176 and diverter 196. Diverter 196 is slightly recessed in rounded cover 176, and when vent portion 182 is attached to fresh food compartment liner 108 (shown in FIGS. 1–4), gaskets 202 seal vent portion 150 from fresh food compartment 102 and prevent mixing of fresh food compartment air with freezer compartment air inside of vent portion 182. When attached to liner 108, diverter 196 extends between liner 108 and cover 176. Inlet ends 190, 198 are placed in flow communication with hood portion 180 (shown in FIG. 4) and outlet ends 192, 200 are placed in flow communication with discharge 178 (shown in FIGS. 3 and 4).

Diverter 196 is closed at inlet end 198 so that freezer compartment air is forced into a primary flow path between diverter 196 and liner 108. A secondary flow path is created between diverter 196 and cover 106. Secondary flow path includes a longitudinal portion 204 extending parallel to a longitudinal axis 206 of vent portion 182, and a plurality of lateral portions 208 extending generally transverse to longitudinal portion 204. In an exemplary embodiment, diverter 196 is fabricated from expanded polystyrene (EPS), and secondary flow path is integrally formed into diverter 196. In alternative embodiments, diverter 196 is fabricated from other known materials and in further embodiments is of a multi-piece construction.

The secondary flow path of diverter 196 is enclosed by cover 176. Cover vents 174 (shown in FIGS. 1 and 3) are positioned adjacent lateral portions 208 of secondary path so that freezer compartment air is distributed radially from curved cover 176 at a full width of lateral portions 208 of the secondary flow path. In an exemplary embodiment, cover is fabricated from a known plastic material and contains a separately fabricated diverter 196. It is contemplated, however, that in alternative embodiments, cover 176 and diverter 196 may be fabricated from the same material, and may even be integrally formed in, for example, a known molding operation.

Diverter includes a plurality of diverter openings 210 positioned between inlet end 198 and outlet end 200 and establishing flow communication between the primary flow path and the secondary flow path. A size of openings 210 decreases from inlet end 198 to outlet end 200, and each opening 210 is positioned within longitudinal portion 204 of the secondary flow path, i.e., away from lateral portions 208 of the secondary flow path. Therefore, as freezer compartment air travels from inlet end 198 to outlet end 200, a portion of the air in the primary airflow path is diverted through each successive diverter opening 210 and into longitudinal portions 204 of the secondary flow path. Once in the secondary flow path, air flows downwardly to lateral portions 208 of the secondary flow path and a portion of the air in lateral portions 208 flows through vents 174 in cover 176 and into fresh food compartment 102.

As diverter openings are larger near inlet end 198, more air is diverted from the primary flow path in upper regions of vent portion 182 than in lower regions of vent portion 182, thereby metering air distribution to select locations in a manner to balance temperature gradients in fresh food compartment 102. With properly dimensioned diverter openings 210, secondary flow path portions, and cover vents 174 located at strategic vertical locations in fresh food compartment 102, a substantially uniform temperature gradient in fresh food compartment 102 is realized. It is appreciated that appropriate dimensions will vary for particular refrigerator capacities, platforms and configurations.

Cover outlet end 192 extends beyond diverter outlet end 200 so that the primary and secondary flow paths converge as air is moved toward storage drawer discharge 178 (shown in FIGS. 3 and 4).

Figure 6:
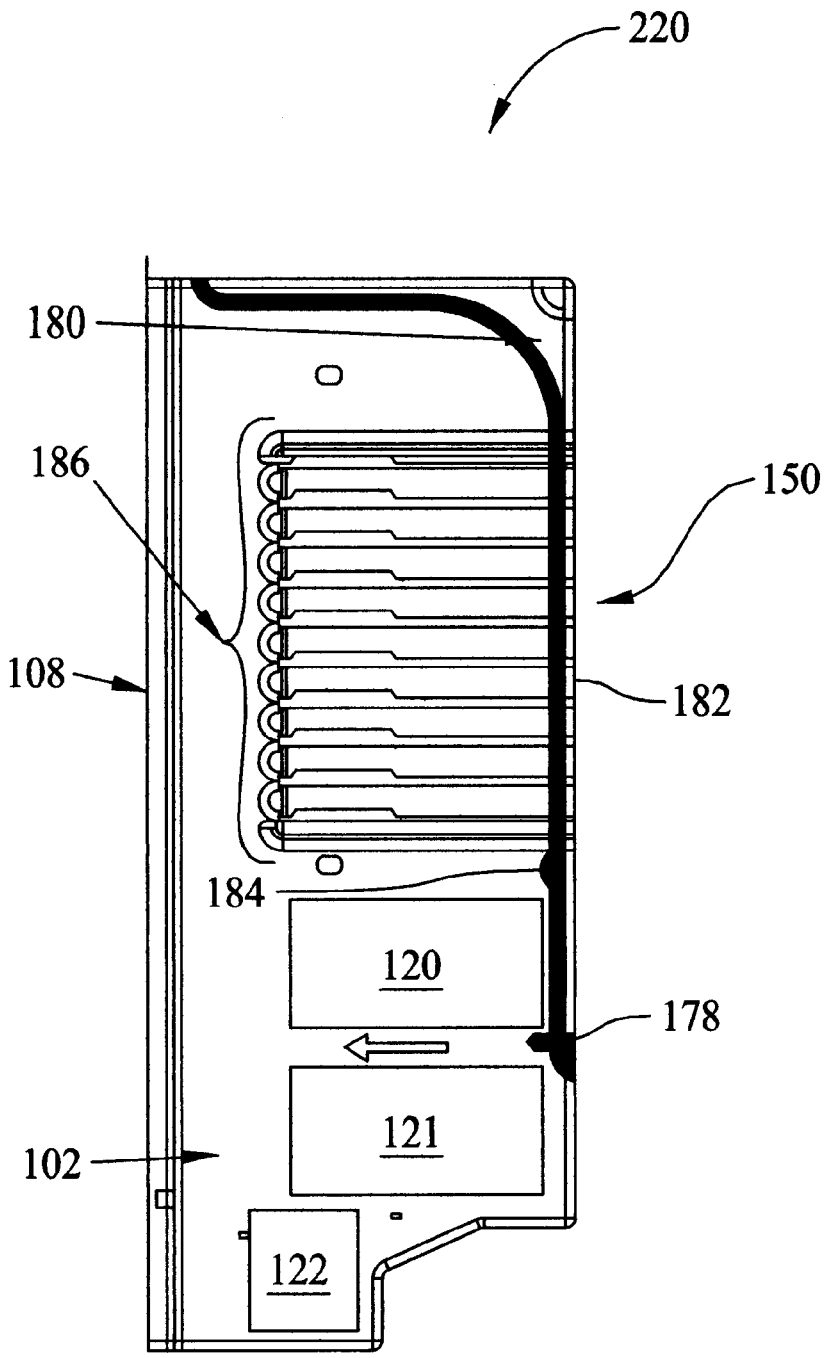
FIG. 6 is a cross-sectional view of a portion of another embodiment of a refrigerator.

FIG. 6 is a sectional view of another embodiment of a refrigerator 220 wherein common elements with refrigerator 100 (as described in FIGS. 1–5 are illustrated with like reference characters. Air distribution assembly extends along a top and rear wall of liner 108 in fresh food compartment 102, and includes a hood portion 180 extending along the top of fresh food compartment 102, a discharge 178 positioned between storage drawers 120 and 121 (also shown in FIG. 2), and a vent portion 182 extending between hood portion 180 and discharge 178. In one embodiment, a manually adjustable knob 184 is located proximally to discharge 178 for user adjustment of airflow through discharge 178 into storage drawer 120. In an alternative embodiment, electronic controls are employed to select, deselect, and adjust airflow into storage drawer 120.

Air distribution assembly 150, as illustrated in FIG. 6, is compact in size to minimize impact on useable space in fresh food compartment 102, while providing regulated airflow into lower portions of fresh food compartment 102 to reduce temperature gradients therein. Vents 174 (shown in FIG. 3) are strategically positioned at selected vertical elevations to optimize airflow conditions in fresh food compartment 102 over a range of shelf positions 186 with respect to liner 108. By positioning air distribution assembly discharge 178 between storage drawers 120 and 121, airflow is facilitated between storage drawers 120 and 121 toward a front of fresh food compartment 102 (as illustrated by the arrow in FIG. 6) and into lower bins 142 (shown in FIG. 1) of fresh food compartment door 134 (shown in FIG. 1). Thus, unlike refrigerator 100 (shown in FIGS. 1–5) in which air distribution assembly 150 delivers regulated airflow into storage drawer 120 (shown in FIGS. 1 and 2), air distribution assembly 150 in refrigerator 220 delivers regulated airflow around storage pans 120, 121 to the front of lower fresh food compartment 102.

In a further embodiment, additional air distribution assembly discharges 178 may be positioned between, for example, drawers 121 and 122 to further reduce temperature gradients in a lower portion of fresh food compartment 102.

A cost effective airflow distribution assembly is therefore provided that achieves desirable air temperature balance in a refrigerator fresh food compartment with minimal impact on usable fresh food compartment space and while providing freezer compartment air for temperature regulation of a fresh food drawer.

While the invention has been described in terms of various specific embodiments, those skilled in the art will recognize that the invention can be practiced with modification within the spirit and scope of the claims.

What is claimed is:

1. An airflow distribution assembly for a refrigerator, said airflow distribution assembly comprising:

a diverter comprising a primary flow path and at least one diverter opening therethrough; and a rounded cover enclosing said diverter, said cover and said diverter forming a secondary flow path in flow communication with said first flow path through said diverter opening.

2. An airflow distribution assembly in accordance with claim 1, said diverter comprising a plurality of openings therethrough.

3. An airflow distribution assembly in accordance with claim 2, said diverter comprising an inlet end and an outlet end, said plurality of openings decreasing in size from said inlet end to said outlet end.

4. An airflow distribution assembly in accordance with claim 1 said secondary flow path comprising a longitudinal portion and at least one lateral portion.

5. An airflow distribution assembly in accordance with claim 4 wherein said cover comprises at least one therethrough, said opening in said cover positioned adjacent said lateral portion of said secondary flow path.

6. An airflow distribution assembly in accordance with claim 1 wherein said diverter comprises an outlet end and said cover comprises an outlet end, said outlet end of said cover extending beyond said outlet end of said diverter.

7. An airflow distribution assembly in accordance with claim 1 further comprising a sealing gasket extending between said diverter and said cover.

8. An airflow distribution assembly in accordance with claim 1 further comprising a storage pan discharge extending from said cover.

9. A refrigerator comprising:

a freezer compartment;

a fresh food compartment;

a first storage drawer located in a lower portion of said fresh food compartment;

a second storage drawer located in a lower portion of said fresh food compartment; and an airflow distribution assembly located in said fresh food compartment and in flow communication with said freezer compartment, said airflow distribution assembly configured to direct air between said first storage drawer and said second storage drawer, said airflow distribution assembly comprising:

a cover comprising a plurality of vents therethrough; and a diverter within said cover, said diverter configured to direct airflow between a primary flow path and a secondary flow path, said secondary flow path extending between said cover and said diverter.

10. A refrigerator in accordance with claim 9, said fresh food compartment comprising a liner, said primary flow path extending between said diverter and said liner.

11. A refrigerator in accordance with claim 10, said diverter comprising a plurality of diverter openings therethrough and establishing flow communication between said primary flow path and said secondary flow path.

12. A refrigerator in accordance with claim 10, said diverter comprising an inlet end and an outlet end, said plurality of diverter openings decreasing in size from said inlet end to said outlet end.

13. A refrigerator in accordance with claim 9 further comprising a storage pan discharge extending from said cover.

14. A refrigerator in accordance with claim 9, said fresh food compartment comprising a rear wall, said diverter extending along said rear wall.

15. A refrigerator in accordance with claim 9, said secondary flow path comprising a longitudinal portion and a plurality of lateral portions, said vents located adjacent said lateral portions.

16. A refrigerator comprising:

a freezer compartment;

a fresh food compartment;

a first storage drawer located in said fresh food compartment; and an airflow distribution assembly located in said fresh food compartment and in flow communication with said freezer compartment, said airflow distribution assembly comprising:

a cover comprising a plurality of vents therethrough;

a diverter within said cover, said diverter configured to direct airflow between a primary flow path and a secondary flow path to regulate flow of freezer compartment air into said fresh food compartment; and a storage pan discharge extending from said cover for supplying freezer compartment air to said first storage drawer.

17. A refrigerator in accordance with claim 16, said secondary flow path extending between said cover and said diverter.

18. A refrigerator in accordance with claim 17, said fresh food compartment comprising a liner, said primary flow path extending between said liner and said diverter.

19. A refrigerator in accordance with claim 18, said diverter comprising a plurality of diverter openings establishing flow communication between said primary flow path and said secondary flow path.

20. A refrigerator in accordance with claim 16, said refrigerator further comprising a second storage drawer, said airflow distribution assembly further configured to direct air between said first storage pan and said second storage pan.

* * * * *